US008136704B2

(12) United States Patent
Verdan

(10) Patent No.: US 8,136,704 B2
(45) Date of Patent: Mar. 20, 2012

(54) DEVICE FOR APPLYING AN ALUM SOLUTION TO THE BODY

(76) Inventor: Francis Verdan, Panama (PA)

( * ) Notice: Subject to any disclaimer, the term of this patent is extended or adjusted under 35 U.S.C. 154(b) by 493 days.

(21) Appl. No.: 12/296,634

(22) PCT Filed: Mar. 20, 2007

(86) PCT No.: PCT/CH2007/000153

§ 371 (c)(1),
(2), (4) Date: Nov. 15, 2008

(87) PCT Pub. No.: WO2007/115417

PCT Pub. Date: Oct. 18, 2007

(65) Prior Publication Data

US 2009/0179051 A1 Jul. 16, 2009

(30) Foreign Application Priority Data

Apr. 11, 2006 (CH) ..... 599/06

(51) Int. Cl.
*B67D 5/60* (2006.01)

(52) U.S. Cl. ..... 222/321.7; 222/464.1; 222/382

(58) Field of Classification Search .... 222/321.7–321.9, 222/382, 464.1, 321.1, 383.1, 383.3
See application file for complete search history.

(56) References Cited

U.S. PATENT DOCUMENTS 2,630,942 A 3/1953 Shaffer
3,089,624 A 5/1963 Micallef
3,137,416 A * 6/1964 Shepherd et al. ..... 222/192
3,257,036 A 6/1966 Micallef
3,463,093 A * 8/1969 Pilz et al. ..... 417/547
3,544,258 A 12/1970 Presant et al.
3,545,488 A 12/1970 Venus, Jr.
4,322,020 A 3/1982 Stone
4,327,782 A 5/1982 McKibben et al.
4,935,224 A * 6/1990 Russo et al. ..... 424/47
(Continued)

FOREIGN PATENT DOCUMENTS

EP 0 852 210 A2 7/1998
(Continued)

*Primary Examiner* — Kevin P Shaver
*Assistant Examiner* — Donnell Long
(74) *Attorney, Agent, or Firm* — Bacon & Thomas, PLLC

(57) ABSTRACT

This device for applying a deodorant comprises a chamber (1) which is a transparent bottle, which contains a saturated alum solution (2) and alum crystals (3). The device is equipped with a conventional hand pump (4) provided with a push-button (5) to allow the solution to be extracted and sprayed onto the body. The bottom of the pump has an inlet (6) via which the solution is drawn up when the pump is operated. A cylindrical second chamber (8) is fixed around the bottom of the pump via its upper end (9). The lower end (12) of the second chamber extends down to the bottom (10) of the bottle, but leaving a gap to allow the solution drawn up by the pump to pass through the passage (11) left open. The interior volume (13) of the second chamber (8) is at least three times greater than the volume of the solution that the pump can extract in a single press of the push-button. Each time the push-button is pressed, the pump therefore extracts only the top portion contained in the second chamber, which means that the small crystals, which are not carried up as high as this, do not block the pump. The volume of solution contained in the second chamber allows several applications in the inverted position.

7 Claims, 2 Drawing Sheets

U.S. PATENT DOCUMENTS

| | | | | | |
|---|---|---|---|---|---|
| 4,949,878 | A | * | 8/1990 | Jacobi | 222/382 |
| 5,068,099 | A | * | 11/1991 | Sramek | 424/47 |
| 5,450,983 | A | | 9/1995 | Stern et al. | |
| 5,518,150 | A | | 5/1996 | Witt, Jr. | |
| 5,544,682 | A | | 8/1996 | McDaniel | |
| 5,624,060 | A | | 4/1997 | Ellion et al. | |
| 5,934,519 | A | | 8/1999 | Kim et al. | |
| 6,158,617 | A | | 12/2000 | Hershey et al. | |
| 6,394,319 | B1 | | 5/2002 | Pucillo | |
| 6,701,975 | B1 | * | 3/2004 | Neal | 141/18 |
| 2004/0112922 | A1 | | 6/2004 | Ouellette | |

FOREIGN PATENT DOCUMENTS

| | | |
|---|---|---|
| EP | 1 527 823 A2 | 5/2005 |
| WO | WO 89/11849 | 12/1989 |

* cited by examiner

DEVICE FOR APPLYING AN ALUM SOLUTION TO THE BODY

TECHNICAL FIELD

The present invention relates to devices for applying saturated alum solutions, on the skin, essentially as deodorants; these solutions can obviously contain other ingredients, such as alcohol, preservatives, or any other agent, for example antiperspirant agents. Since the solution is saturated, it necessarily contains undissolved alum crystals.

As ammonium alum crystals have a density of 1.65, and potash alum crystals have a density of 1.73, the difference is minimal and the invention therefore applies to any type of saturated alum solution.

BACKGROUND ART

We know of devices consisting of a receptacle or bottle, preferably transparent, containing a saturated alum solution, in which are immersed undissolved alum crystals, and which are fitted with a manually-operated push-button pump for spraying the solution on to the body part targeted by the user. As in the overwhelming majority of hand-held spray pump devices, said pump is fixed in a removable fashion on the top of the bottle, generally by means of a screw type fixture. The preferable solvent for the solution is water. When the level of the alum solution is low, the user needs only to unscrew the pump and refill the bottle with water. A portion of the crystals present in the bottle dissolve, until the saturation point is reached. Since water is available almost everywhere, and is usually free, the user can refill the device several times, until the crystal reserve is completely dissolved. This allows the device to be of a compact size, which makes it easily transportable and therefore practical. Moreover, the saturation point of the solution increases with temperature. Therefore the deodorant effect of the application increases with temperature, which corresponds with natural needs. Such a device, proposed in application PCT/CH89/00104 Verdan (publication WO89/11849), was taken up in the U.S. Pat. No. 5,544,682 McDaniel and in corresponding patents, as well as in patent EP 0 852 210 Valois. In each of these publications, the pump spray screwed on to the top of the bottle containing the alum solution is fitted with a tube that extends to the bottom of the bottle, in a conventional manner, such that pumping the solution remains possible even if the level is low. In devices PCT/CHS9/00104 Verdan and EP 0 852 210 Valois, the tube extends down almost the whole length of the bottle and its lower end arrives a short distance away from the bottom. In order to prevent the pump from drawing up small crystals and becoming clogged, the lower end of the tube is fitted with a filter. Use of this device, however, was unsatisfactory, since the small crystals caked together on the filter and clogged it in a relatively short period of time. To overcome this drawback, U.S. Pat. No. 5,544,682 McDaniel simply proposes to shorten the tube, such that it reaches halfway down the solution. Indeed, the product is marketed in this form. The alum crystals, which have a specific gravity of around 1.7, settle on the bottom of the bottle. In the top portion of the solution, the quantity of crystals is significantly lower, or even non-existent, since the crystals settle rapidly. The shortened tube therefore only pumps from this top portion, and the risk of suctioning a crystal is low. This proposal has the drawback that half of the alum solution remains out of reach of the pump, and therefore it is necessary to refill the bottle twice as often (or transport a bottle twice as large).

Moreover, a general problem exists, whose solution has solicited numerous proposals, of allowing the user to employ the spray not only in a position in which the pump is at the top, but also when the bottle is tilted or inverted and the pump is at the bottom. In this respect, the idea of stopping the tube feeding the pump at halfway down the bottle provides a partial solution, but it only works until the bottle becomes half empty. Other proposed solutions include document U.S. Pat. No. 5,934,519 Kim, in which the suction tube is flexible and is weighted at the end thereby extending this end to the lowest point in the bottle, regardless of the latter's position. This solution is again found in documents U.S. Pat. No. 6,394,319 Pucillo and EP 1 527 823 Saint-Gobin Calmar Inc. The drawback of this solution is the same as that in document PCT/CH89/00104 Verdan: in a saturated alum solution, the end of the tube, whether a filter is provided or not, will soon become clogged, since the filter is always in the sector containing the greatest quantity of crystals. It is true that these proposals are not presented for the application of saturated alum solutions. Other documents propose receptacles or bottles which are also not intended for the application of a saturated alum solution, in which the suction tube has several branches, one of which ends at the bottom of the bottle and one or several others end in other sectors, notably at the top of the bottle. This is the case for example in documents U.S. Pat. No. 2,630,942 Shaffer, U.S. Pat. No. 3,545,488 Venus, and U.S. Pat. No. 5,624,060 Ellion. The difficulty with these proposals lies mainly in the need to produce quite complex suction tubes. Moreover, there is still the aforementioned drawback of the risk of blockage should these proposals be applied to the spraying of a saturated alum solution. Other documents propose dividing the bottle into several compartments, such that at least one of the compartments retains the liquid even in an inverted position. This is the case for documents US 2004/0112922 Ouellette and U.S. Pat. No. 5,518,150 Witt. However, neither of these solutions permits use when the bottle is completely inverted, vertically. Moreover, the use of a standard bottle is impossible. Still other documents propose including in the bottle a second sealed and more or less flexible chamber containing the solution to be dispensed, which collapses as the liquid it contains is pumped. This is the case for example in documents U.S. Pat. No. 3,089,624 Micallef, U.S. Pat. No. 3,257,036 Micallef and U.S. Pat. No. 4,322,020 Stone. The disadvantage of these solutions lies notably in the need to insert and fix a second chamber within the bottle, which appears to be rather complex. It is the object of the present invention to provide a device that overcomes the aforementioned drawbacks, i.e. a device that allows almost all of the alum solution to be suctioned while minimising the risk of the pump becoming clogged with crystals, as well as the use of the bottle in all positions, even when it is inverted completely.

DISCLOSURE OF THE INVENTION

In its most general embodiment, the device for applying an alum solution according to the invention, comprising at least a first chamber containing a saturated alum solution and alum crystals, a pump which can be operated by at least one push-button, enabling the emission of a portion of the solution to a targeted area of the body, said pump having at least one inlet linking the pump to the first chamber, is characterised in that it comprises at least one second chamber into which the upper part of said inlet opens directly or through at least one conduit having at least one suction point, the second chamber extending towards the bottom of said first chamber, at least one passage being arranged in the lower part of said second chamber such as to make the interior volume of said second chamber communicate with said first chamber, such that the saturated alum solution and the alum crystals at least partially fill said second chamber, said upper part being fixed, so as to be sealed, directly or indirectly at the top of the first chamber or to the pump, such as to prevent any transfer of said alum solution between said chambers by any other way than said passage.

In a particular embodiment of the invention, the device according to the invention is characterised in that the interior volume of the second chamber between the inlet and the highest point of the passage represents at least three times the volume of the alum solution that the pump can extract during a single stroke of the push-button.

In a second particular embodiment of the invention, applicable to the preceding embodiment and to the general embodiment, the device according to the invention is characterised in that the second chamber is in the form of a hollow cylinder, the passage being formed by the lower aperture of said cylinder.

In a third particular embodiment of the invention, applicable to the previous embodiments and to the general embodiment, the device according to the invention is characterised in that a filter is fitted in front of the suction point.

In a fourth particular embodiment of the invention, applicable to the preceding embodiments and to the general embodiment, the device according to the invention is characterised in that the distance between the bottom of the second chamber and the bottom of the first chamber is less than the internal diameter of said cylinder.

In a fifth particular embodiment of the invention, applicable to the previous embodiments and to the general embodiment, the device according to the invention is characterised in that the second chamber is transparent.

In a sixth particular embodiment of the invention, applicable to the previous embodiments and to the general embodiment, the device according to the invention is characterised in that the filter is placed in the upper part of the second chamber.

BRIEF DESCRIPTION OF THE DRAWINGS

The drawings represent two embodiments of the invention.

BEST MODE FOR CARRYING OUT THE INVENTION

Figure 1:
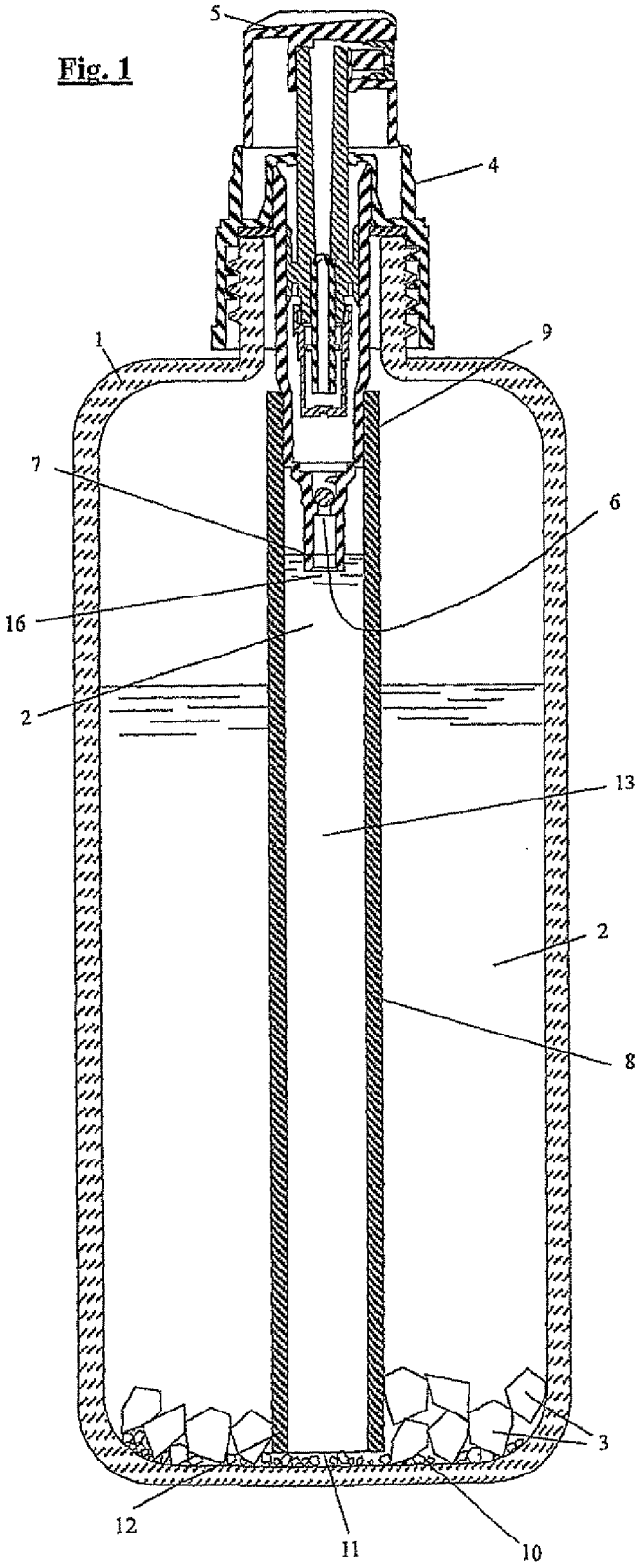
FIG. 1 is a vertical section of a device in one embodiment of the invention, in the upright position, with the pump at the top.
Figure 2:
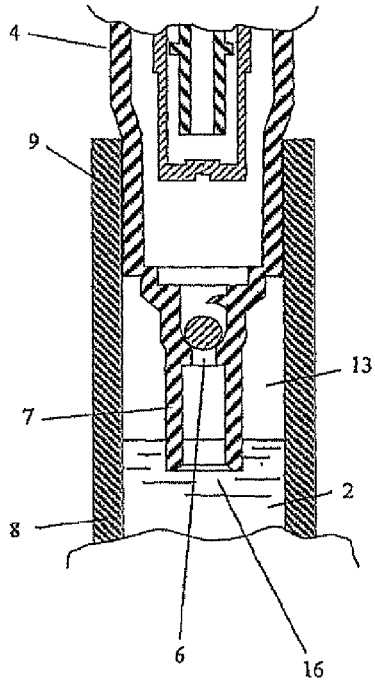
FIG. 2 is an enlarged view of the lower part of the pump depicted in FIG. 1, together with the surrounding second chamber according to the invention.

The device comprises at least one chamber 1, the walls of which are preferably transparent, i.e. in practice, made of a plastic material or glass, and which is provided with a screw neck on to which a hand pump 4 is screwed. This pump 4, depicted diagrammatically and notably without the springs, is a common model. It is operated by a push-button 5. The first chamber 1 is filled with a saturated alum solution 2. The preferable solvent is water. Alum crystals 3 are immersed in this solution, ensuring constant saturation of the solution, even after the chamber has been refilled several times with water, until they have dissolved completely. Obviously, the bottle is filled through the neck, after unscrewing the pump. The pump is operated manually by means of the push-button 5. Details of the pump are not depicted here. The pump inlet 6, under the ball serving as a valve, is visible particularly in FIG. 2.

In the embodiment shown here, the pump inlet 6 is extended by a conduit 7 which shifts the position of the suction point 16 to the end of this conduit. The diameter of this conduit corresponds roughly to that of the valve ball. Usually, a suction tube 15 is placed in the conduit bore 7, and extends to the bottom of the bottle, as is the case in document PCT/CH8900104 Verdan. As we have seen, when there are solids in the solution, these narrow conduits forcefully suck up the tiny crystals present in the solution. The conduit channels the tiny crystals into the pump, preventing it from operating correctly.

To overcome this clogging effect, the device according to the invention comprises at least one second chamber 8, which here takes the form of a cylindrical tube, but which could take other forms. The second chamber surrounds the bottom of the pump 4 via its upper end 9. There is no gap between this upper end 9 and the bottom of the pump, such that the fixation between the bottom of the pump and the upper end 9 is sealed and prevents any passage of the alum solution through the top of the second chamber 8. The second chamber 8 extends down to the bottom 10 of the first chamber 1. However, a passage 11 opens to let the solution pass through this lower end 12. In the present case, the passage 11 is formed simply by the lower opening of said second chamber. The solution can flow inside 13 the second chamber 8 through this passage 11, because of the distance, which is preferably quite short, that is provided between the lower end 12 of the second chamber and the bottom 10 of the first chamber.

It is essential that the volume of the second chamber be sufficiently large and that its size be such that the volume of alum solution 2 extracted during a single complete stroke of the push-button 5 does not represent more than a relatively small fraction of the volume contained in the second chamber 8. In prior art devices, which have a narrow suction tube, a single press of the push-button draws up the entire contents of the tube, and even more. A very rapid current follows, which sweeps the small crystals towards the inlet of the pump and the valve, tending to clog them up. Conversely, in the device according to the invention, a press of the push-bottom only draws up a portion of the solution which is located at the top of the second chamber.

Obviously this produces a current, but it is virtually nothing and is far less strong than the current produced in the prior art devices. It follows that the small crystals are hardly drawn into the second chamber 8 and that they scarcely rise towards the pump, which eliminates the risk of the crystals being present around the suction point 16. Because of the force of gravity, the crystals remain at the bottom of the bottle and are never in contact with the suction point 16 of the pump. On the other hand, the liquid will remain in the second chamber up to the height of the suction point 16 even if the level of the liquid is lower than said suction point in the first chamber. This is due to the fact that the second chamber 8 is hermetically sealed at its highest point, thereby preventing the liquid in the pump from escaping, as no air can enter to replace the liquid. The second chamber 8 will thus remain full until the liquid in the first chamber is completely used up.

The partial or complete clogging of the pump is thus almost entirely prevented.

Figure 3:
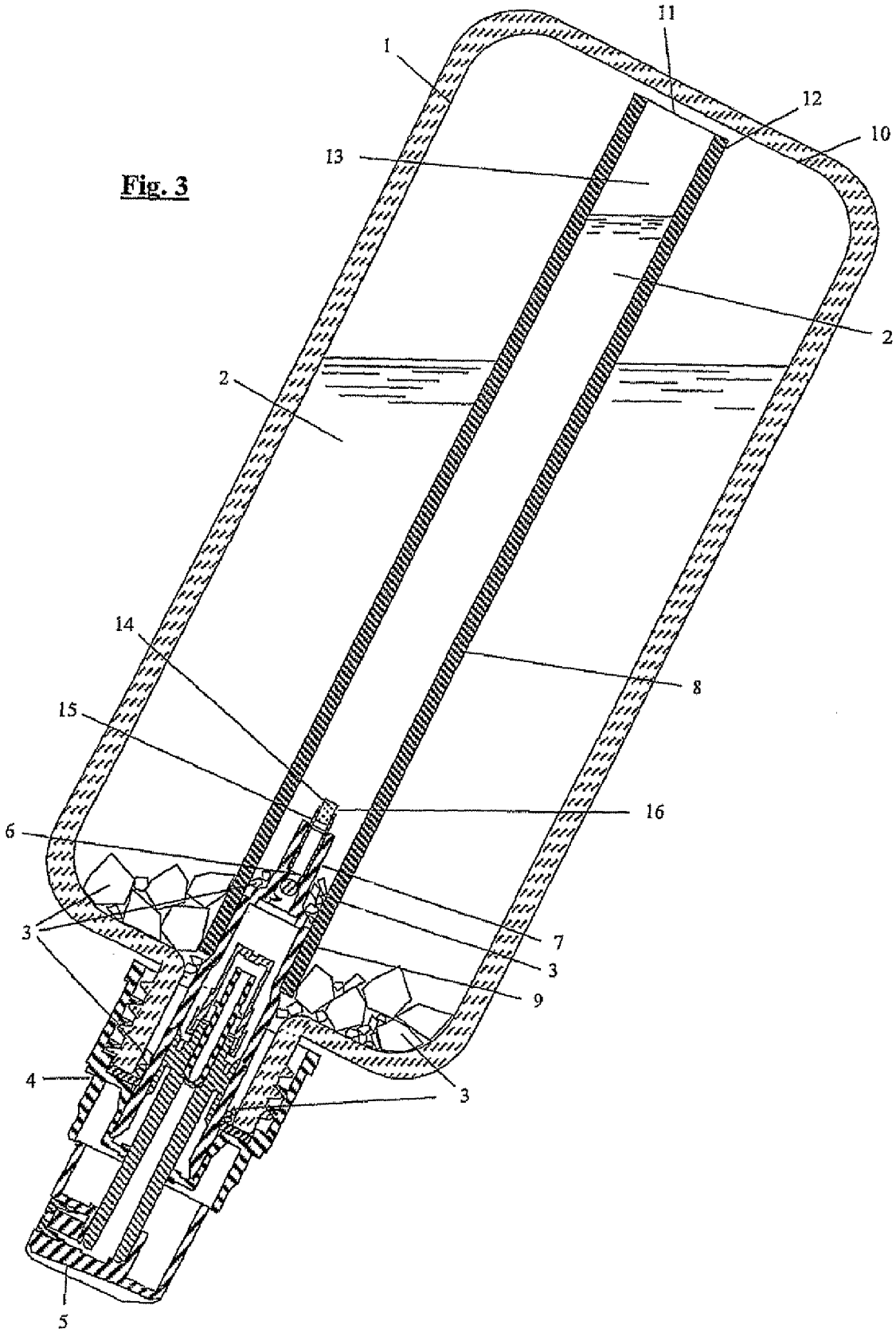
FIG. 3 is a section view like that in FIG. 1, but wherein the device is tilted, with the pump at the bottom, at the inlet of which a filter has been added such as to prevent the infiltration of tiny crystals into the pump.

Moreover, as depicted in FIG. 3, the quantity of alum solution 2 inside the second chamber is sufficient to provide several applications in the inverted position where the pump is at the bottom.

Preferably, the interior volume 13 of the second chamber 8 represents at least three times the volume of alum solution that the pump can extract during a single stroke of the push-button 5, i.e. during the operation consisting of pressing the push-button 5 from its highest position to its lowest position, without the opposite movement, i.e. without the user lifting his finger during the operation. This allows the user, for example, to easily use the device for an application on the feet, which generally requires the bottle to be inverted.

The slightest drop in temperature of a saturated alum solution results in the formation of tiny alum crystals which, depending on the quantity, could prevent the pump from functioning properly. To overcome this risk, a filter can be inserted before the suction point 16 of the pump. Considering the foregoing, it is important that the filter be placed as close as possible to the suction point 16.

FIG. 3 depicts an embodiment wherein a tube 15 is fixed in the inlet 6 of the pump 4, thereby shifting the suction point 16 to the end of the tube 15, in which a filter 14 is inserted. This solution prevents the small crystals from entering the pump and blocking it. The risk of clogging the filter certainly still exists, but it is diminished because the filter is located in an area where there is a lower density of crystals, at least when the bottle is held upright, with the pump at the top. Should the bottle be inverted, and the crystals enter the interior space 13 of the second chamber 8 through the passage 11, these crystals would tend to settle, because of the inverted position, on the bottom close to the pump, as depicted in FIG. 3. The tube 15 and filter 14, because of their length, are outside this area, so that the risk of clogging is reduced. When the bottle is returned to its normal upright position, the crystals again fall to the bottom 10 of the first chamber.

INDUSTRIAL APPLICABILITY

The invention, which can easily be produced with prior art methods, can be used in the cosmetics industry, for applying an alum solution as a deodorant.

The invention claimed is:

1. Device for applying an alum solution comprising at least a first chamber (1) containing a saturated alum solution (2) and alum crystals (3); a pump (4) capable of being operated by at least one push-button (5) and enabling the emission of a portion of the solution towards a part of a body, the pump (4) having at least one inlet (6) linking the pump (4) to the first chamber (1); at least one second chamber (8) into which the upper part (9) of said inlet (6) opens directly or through at least one conduit (7) having at least one suction point (16), said second chamber extending towards the bottom (10) of said first chamber; at least one passage (11) being arranged in the lower part (12) of said second chamber such as to make the interior volume (13) of said second chamber communicate with said first chamber, such that the saturated alum solution and the alum crystals at least partially fill said second chamber; said upper part (9) being fixed, so as to be sealed, directly or indirectly at the top of the first chamber or to the pump, such as to prevent any transfer of said alum solution between said chambers by any other way than said passage (11), wherein the interior volume (13) of the second chamber (8) between the inlet (6) and the highest point of the passage (11) represents at least three times the volume of the alum solution that the pump (4) can extract during a single stroke of the push-button.

2. Device according to claim 1, wherein the second chamber is in the form of a hollow cylinder, said passage being formed by a lower aperture of said cylinder.

3. Device according to claim 1, including a filter (14) fixed in front of the suction point (16).

4. Device according to claim 2, wherein the distance between the bottom of the second chamber and the bottom (10) of the first chamber is less than the internal diameter of said cylinder.

5. Device according to claim 1, wherein the second chamber is transparent.

6. Device according to claim 3, wherein the filter (14) is disposed in the upper part (9) of the second chamber.

7. Device according to claim 1, wherein the distance between the bottom of the second chamber and the bottom (10) of the first chamber is less than the internal diameter of said cylinder.

* * * * *